US005918690A

United States Patent [19]

Hailey

[11] Patent Number: 5,918,690

[45] Date of Patent: Jul. 6, 1999

[54] BOTTOM ROTATION SHAFT ACTUATOR

[76] Inventor: Charles D. Hailey, 11628 Burning Oaks, Oklahoma City, Okla. 73150

[21] Appl. No.: 08/794,684

[22] Filed: Feb. 3, 1997

[51] Int. Cl.[6] ..... E21B 4/10

[52] U.S. Cl. ..... 175/298; 175/305; 166/178; 166/301

[58] Field of Search ..... 175/323, 298, 175/300, 305; 166/178, 301, 99

[56] References Cited

U.S. PATENT DOCUMENTS

| | | | |
|---|---|---|---|
| 2,153,883 | 4/1939 | Foster | 175/298 |
| 2,326,394 | 8/1943 | Richey | 175/298 X |
| 2,387,682 | 10/1945 | Richey | 175/298 X |
| 3,834,471 | 9/1974 | Bottoms | 166/178 X |
| 3,884,051 | 5/1975 | Bottoms | 175/321 X |
| 5,584,342 | 12/1996 | Swinford | 166/301 |

*Primary Examiner*—Roger Schoeppel
*Attorney, Agent, or Firm*—McAfee & Taft

[57] ABSTRACT

An actuator for effecting bottom hole rotation consisting of an upper wash pipe having a spiral groove mandrel that is in operative association with a ball clutch assembly that is secured to the upper wash pipe. The weight placed on the actuator at the wash pipe connection is effective to drive the mandrel and ball clutch assembly through a given amount of rotation, e.g., five rotations per actuation can be applied to a selected working tool.

11 Claims, 6 Drawing Sheets

BOTTOM ROTATION SHAFT ACTUATOR

BACKGROUND OF THE INVENTION

1. Field of the Invention

The invention relates generally to a downhole tool for positioning on a drill or tubing string to impart rotational movement to a working implement.

2. Description of the Prior Art

The prior art includes various types of electrical or hydraulic motors that may be included in a sub element along a drill string to impart rotational drive to an associated well tool. In addition, the drill string itself may be capable of rotation to provide the requisite function during drilling operations; however, a tubing string is not capable of controlled rotation and, therefore, a separate rotational source must be supplied and these usually take the form of electrical or hydraulic motors located in a suitable drive sub to provide drive to a working tool therebelow. In many operations, a prolonged or continuous rotation is not required whereupon a controlled rotation device such as the present invention may be acceptable. Thus, the device capable of a predetermined number of finite rotations may be suitable in various downhole operations to operate a recovery tool or the like under control of a surface position.

SUMMARY OF THE INVENTION

The present invention relates to an improved type of actuator for imparting controlled rotation at the bottom of a drill hole. The device may be employed at the bottom of a tubing string to provide rotation to a drive shaft that may be connected to a recovery basket or other downhole devices requiring minimal rotation. The actuator consists of an external housing that is connectable to the tubing string and contains a drive mandrel and ball clutch assembly that is controlled to drive in rotation by application of weight from the tubing string thereby to impart the controlled rotation to a selected working tool that is connected therebelow in the string.

Therefore, it is an object of the present invention to provide an actuator device for imparting a selected amount of rotation to a working tool suspended on a tubing string or the like.

It is also an object of the present invention to provide such controlled rotation in response to increase of weight on the tubing string.

It is yet further an object of the present invention to provide downhole rotation in the presence of debris or other impediments.

Other objects and advantages of the invention will be evident from the following detailed description when read in conjunction with the accompanying drawings that illustrate the invention.

BRIEF DESCRIPTION OF THE DRAWINGS

FIG. 6 is a drawing in elevation with parts shown in cutaway of a drive housing constructed in accordance with the invention;

FIGS. 9A–9D illustrate an assembled view of the parts shown in FIGS. 1–8.

DETAILED DESCRIPTION OF THE INVENTION

Figure 1:
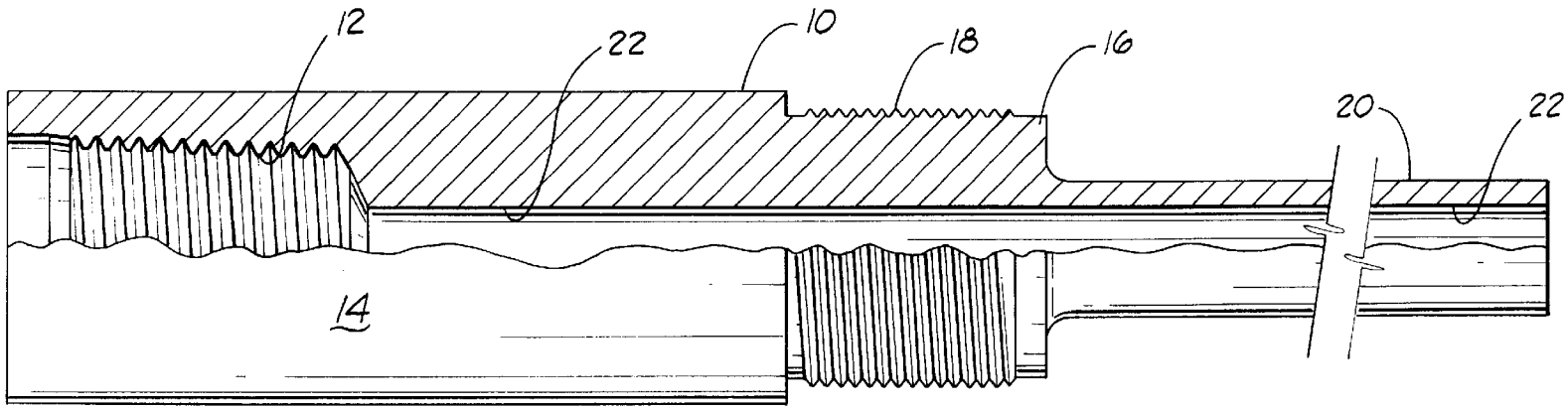
FIG. 1 is a drawing in elevation with sectional cutaway of the top sub wash pipe of the invention.

Referring to FIG. 1, a top sub wash pipe 10 provides the upper end of the actuator tool as it includes a 1.0 inch M.T. box thread 12 which functions to connect to the tubing string or whatever connects thereabove. The mounting thread 12 is disposed in a cylindrical block 14. The wash pipe 10 is then reduced in circumfery to a block portion 16 which also receives threads 18, 1.590 overall diameter 10 pitch, stub acme pin type threads. The wash pipe 10 is then further reduced to an elongated tube 20 having a 0.750 inch outside diameter and an inside diameter 22 of 0.500 inch dimension. The wash pipe 10 has an overall length of 19.5 inches.

Figure 2:
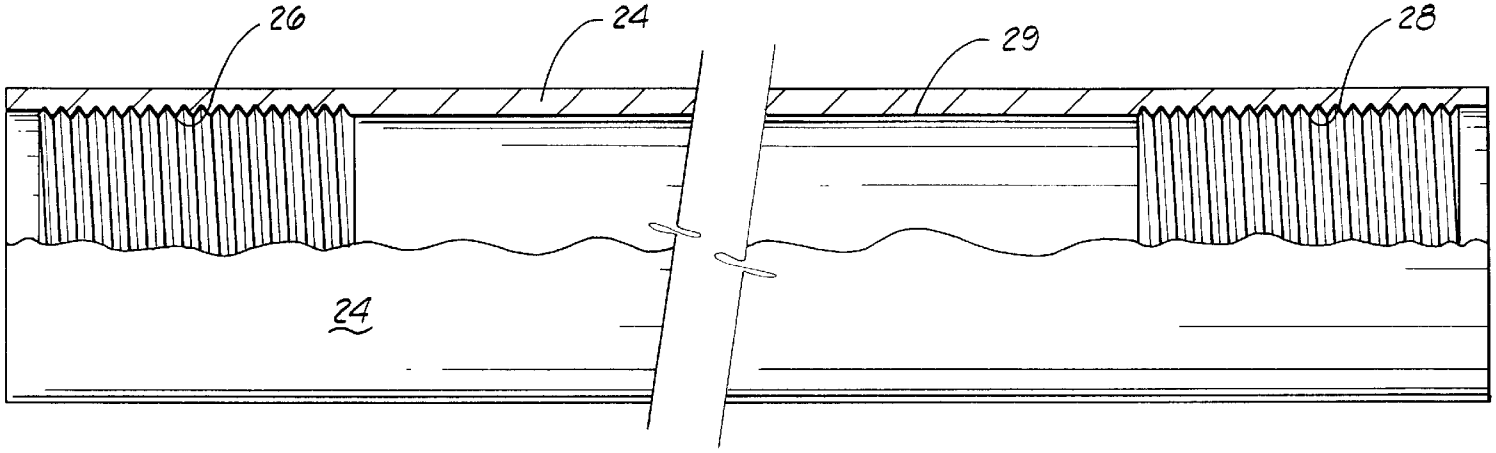
FIG. 2 is a drawing in elevation with partial cutaway section of an upper shaft drive support housing as used in the present invention.

Referring to FIG. 2, an upper shaft drive support housing 24 is formed from a length of pipe, 17.5 inches in length overall, which is threaded internally at each end. Each internal threads 26 and 28 is a 1.590 O.D. 10 pitch, stub acme type thread formed in a 1.530 inch inside diameter bore as the inside diameter 29 of the housing 24 has a dimension of 1.520 inches throughout.

Figure 3:
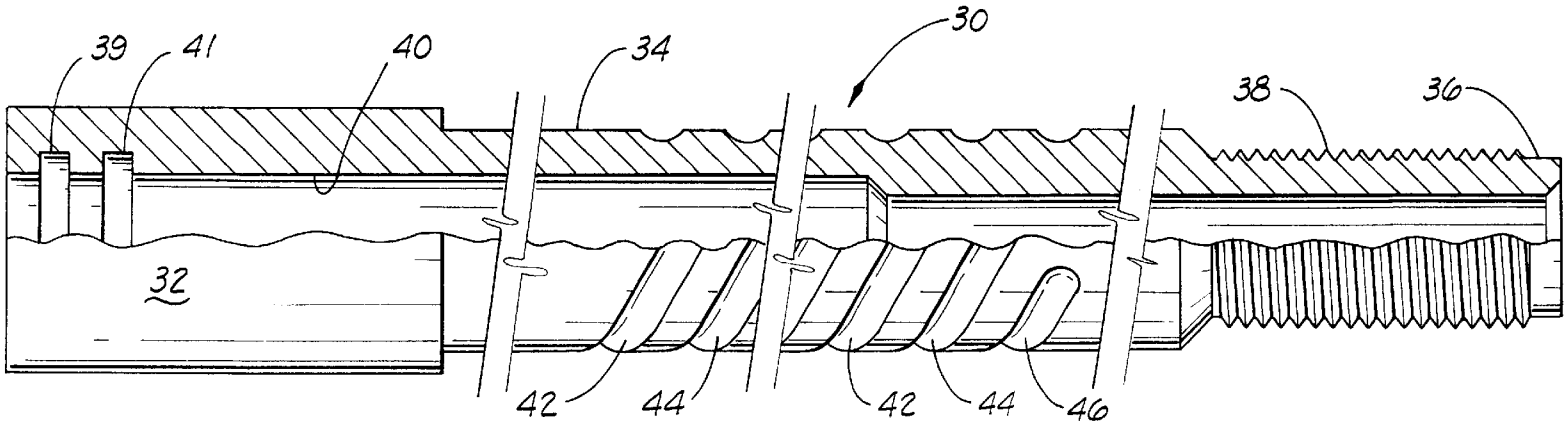
FIG. 3 is a drawing in elevation with partial cutaway section of a drive mandrel as used in the present invention.

FIG. 3 illustrates a drive mandrel 30 which is 25.00 inches overall in length. An end cylinder 32 is stepped down to a diameter of 1.125 inches at groove section 34 and further reduced at the opposite end section 36 to1.0 inch O.D. whereupon a 10 pitch, stub acme thread 38 is formed. The heavier end at cylinder 32 is formed with a bore 40 having a 0.758 inch inside diameter that is further reduced at the opposite end to a 0.500 inch inside diameter tube. Grooves 39 and 41 provide seating for sealing 0-rings. The central surface 34 includes three equally spaced spiral grooves 42, 44 and 46 which function to carry actuator balls of the ball clutch drive, as will be further described below.

Figure 4B:
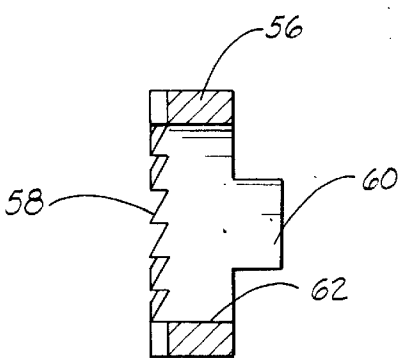
FIGS. 4A and 4B are drawings in section of components of the ball clutch drive of the assembly.
Figure 4A:
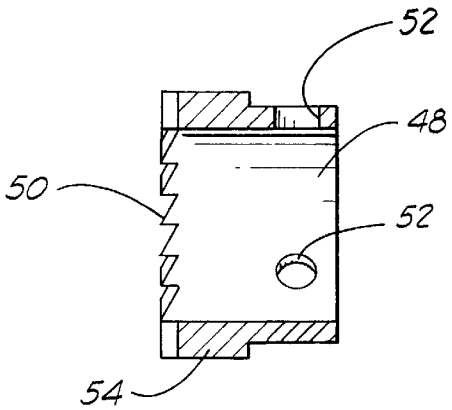

Referring now to FIGS. 4A and 4B, a ball clutch drive consists of a sleeve 48 having an inside diameter of 1.133 inches with a circumfery of ratchet teeth 50 formed about one end and having three equally spaced 0.275 diameter holes 52 formed through the cylindrical side wall 54. Three 0.250 diameter ball bearings operate to ride in the holes 52 while tracking in the spiral grooves 42, 44 and 46 (see FIG. 3). FIG. 4B illustrates a coactive component that rides adjacent to the clutch drive 48 and takes the form of a cylinder 56 having a circumfery of mating teeth 58 on one side and a boss 60 of 0.495 inches width formed on the opposite side. The cylinder 56 includes a bore 62 of 1.133 inches inside diameter. Actually, there are two opposed bosses 60 disposed at 180° on the circumfery of the cylinder 56.

Figure 5:
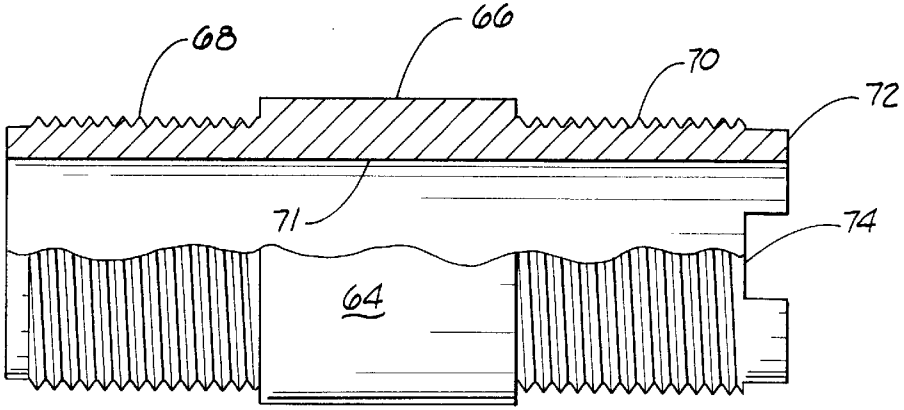
FIG. 5 is a drawing in elevation with a section cutaway of the twin pin drive connector.
Figure 5:
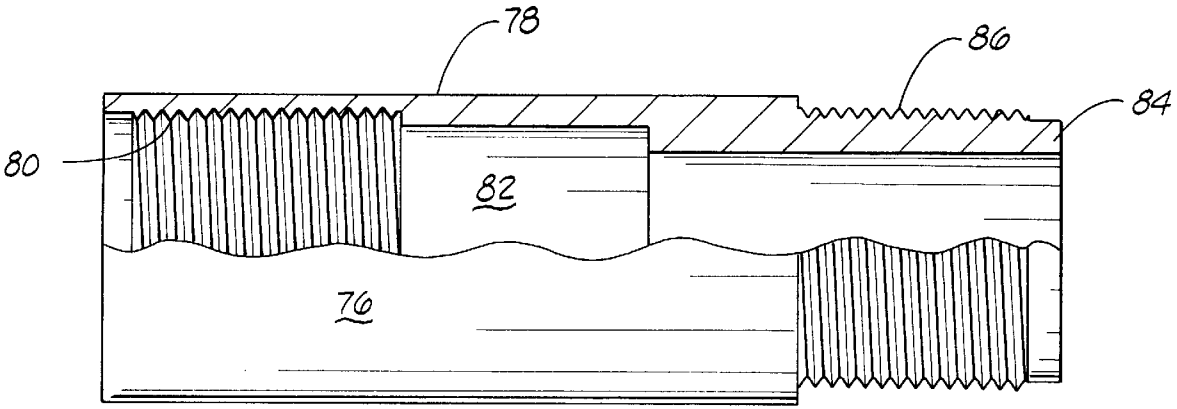

A twin pin drive connector 64 is shown in FIG. 5 and consists of a cylindrical formation having a central cylinder 66 with opposite ends 68 and 70 threaded and a bore 71 of 1.130 inside diameter. The thread formations on opposite ends 68 and 70 are each of 1.590 inches diameter at 10 pitch, stub acme pin formation with the cylindrical end 72 having two 180° displaced boss slots 74 disposed therein. The twin pin drive connector 64 is a relatively short component being 4.625 inches in length overall.

Referring now to FIG. 6, a drive housing 76 consists of a cylindrical portion 78 of 1.813 inches outside diameter having internal end threads 80 that adjoins an interior cylindrical wall 82. The interior threads 80 are 1.590 outside diameter 10 pitch, stub acme box threads. The opposite end 84 of drive housing 76 includes an external thread that is 1.590 inches O.D., 10 pitch, stub acme pin threads 86, and the overall length of the drive housing is 5.625 inches.

Figure 7:
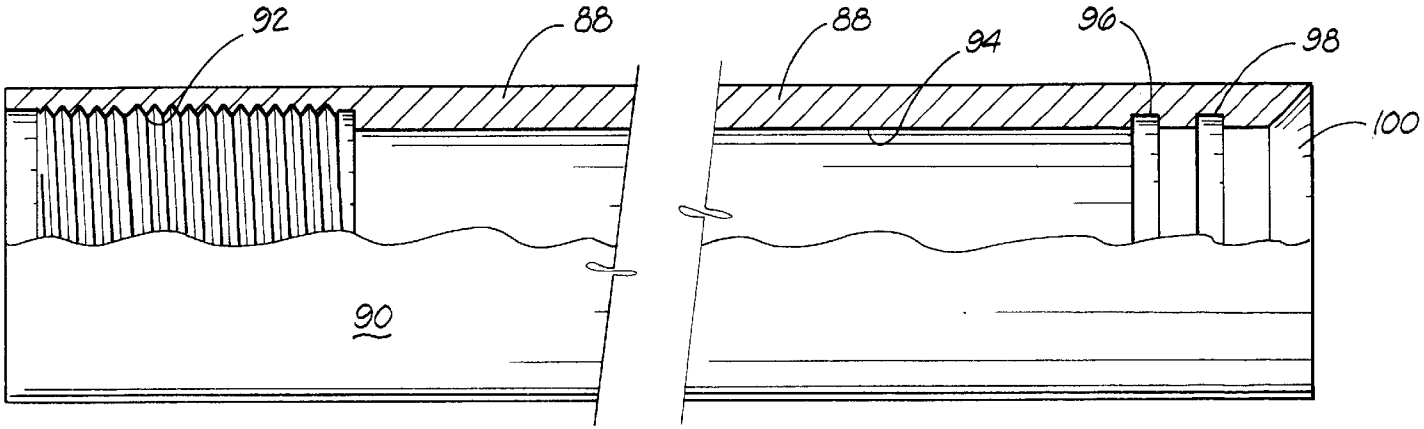
FIG. 7 is a drawing in elevation and partial section of the lower rotor housing.

Referring now to FIG. 7, a cylinder 88 of 1.813 inches outside diameter forms a lower rotor housing 90. One end of cylinder 88 is formed with internal threads 92 which are 1.590 O.D., 10 pitch, stub acme box threads having a 1.530 I.D. bore. A uniform inside bore 94 of 1.320 inches inside diameter includes parallel 0-ring grooves 96 and 98 and a tapered end opening 100 which receives entry of the bottom rotation shaft of FIG. 8. The lower rotor housing 90 is 15.500 inches in overall length.

Finally, a bottom rotation shaft 102 includes a first lesser diameter rotation shaft 104 having internal threads 106 which are 1.0 diameter, 10 pitch, stub acme box threads. The cylindrical shaft 104 then enlarges to a cylindrical head 108 which extends internal tool mounting threads 110, 1.0 inch M.T. box threads which function to receive fixture of a selected working tool for use with the shaft actuator. An internal bore 112 of 0.500 inches inside diameter extends the length of rotation shaft 102 from threads 110 to threads 106. The rotation shaft 102 is 18.312 inches overall in length.

referring to FIGS. 9A–9D, shaft actuator comprises a multi-stage assembly which may start with the insertion of elongated tube 20 (FIG. 1) into the bore 40 of drive mandrel 30 (FIG. 3) until the end cylinder 32 of drive mandrel 30 abuts the block portion 16 of wash pipe 10 (FIG. 1). The support housing 24 (FIG. 2) can then be inserted over the end section 36 of drive mandrel 30 and slid over the groove section 34 to engage the threads 26 (FIG. 2) in tight fixture on threads 18 (FIG. 1) of wash pipe 10.

Next, the twin pin drive connector 64 (FIG. 5) is slid over end section 36 of drive mandrel 30 (see FIG. 3) and moved leftward into threaded engagement as threads 68 screw into internal threads 28 of the upper shaft drive support housing 24 (FIG. 2). The ball clutch cylinder 56 (FIG. 4B) is the next component to slide over the end section 36 of drive mandrel 30 and onto the groove section 34 (see FIG. 3) oriented such that the boss 60 faces the previously positioned twin pin drive connector 64. Succeeding this move, the ball clutch sleeve 48 (FIG. 4A) slides onto end section 36 and groove section 34 of drive mandrel 30 (FIG. 3) with the tooth circumfery 50 facing the tooth circumfery 58 of cylinder 56 (FIG. 4B).

At this stage, the three clutch balls, 0.250 inch diameter ball bearings, are placed in the respective equi-spaced 0.257 inch diameter holes 52 and held in groove position by means of heavy grease until the drive housing 76 (FIG. 6) is slid over the end 36 of drive mandrel 30 (FIG. 3) and positioned over the tracked ball bearings, and the threads 80 of guide housing 76 are secured over threads 70 of guide connector 64 (FIG. 5). Each of the ball bearings is properly tracked when it rolls in a respective groove 42, 44 or 46 of the drive mandrel groove section 34 (FIG. 3).

The lower rotor housing 90 (FIG. 7) is then positioned over end section 36 of drive mandrel 30 and fastened with threads 92 in tight engagement over threads 86 of the drive housing 76 (FIG. 6); and thereafter, the bottom rotation shaft 102 is inserted end 114 first (FIG. 8) through the tapered end opening 100 (FIG. 7) and past the sealing O-rings in grooves 96 and 98 for threaded affixture on the drive mandrel 30 threads 38 as it extends into the inside bore 94 (FIG. 7). When the tool is fully assembled, the lowermost portion is the cylindrical head 108 which includes the tool mounting threads 110 that retain the rotating implements.

Once the tool is assembled and ready for operation, it may be connected for downhole suspension at the box thread 12 of top sub wash pipe 10 (FIG. 1). The remainder of the tool suspends therefrom as the drive mandrel 30 is suspended beneath the wash pipe 10 and retained thereon by means of the combination of interconnected elements constituting the clutch drive mechanism (FIGS. 4A and 4B), upward drive support housing 24 (FIG. 2), the twin pin drive connector 64 (FIG. 5), drive housing 76 (FIG. 6), and lower rotor housing 90 (FIG. 7). The only connection between the combination components and the suspended drive mandrel 30 is through the three drive balls which ride in the respective grooves 42, 44 and 46 of drive mandrel 30.

Figure 8:
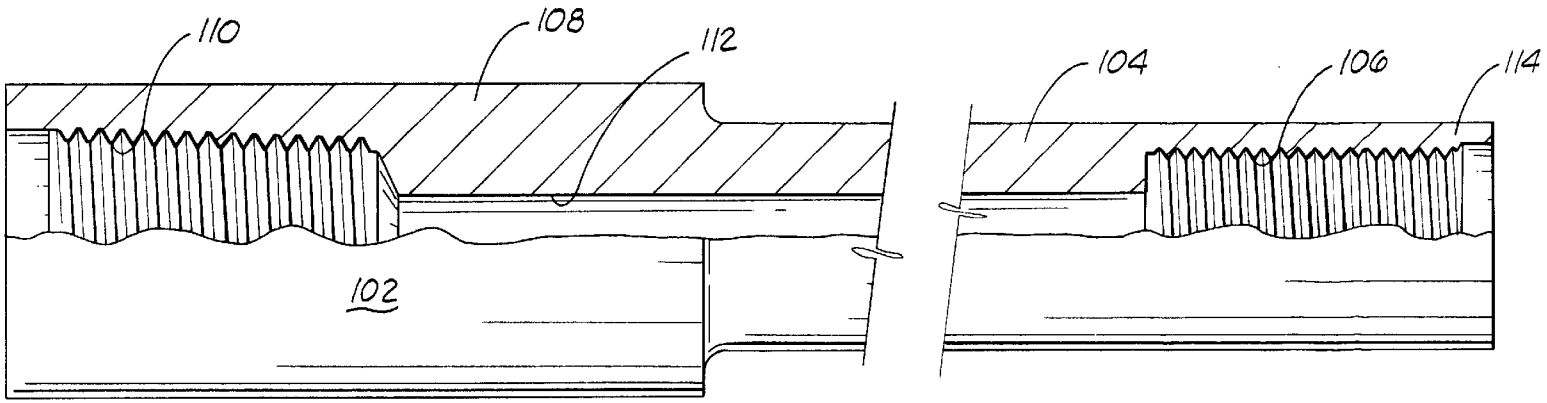
FIG. 8 is a drawing in elevation with parts shown in cutaway of the bottom rotation shaft.
Figure 5A:
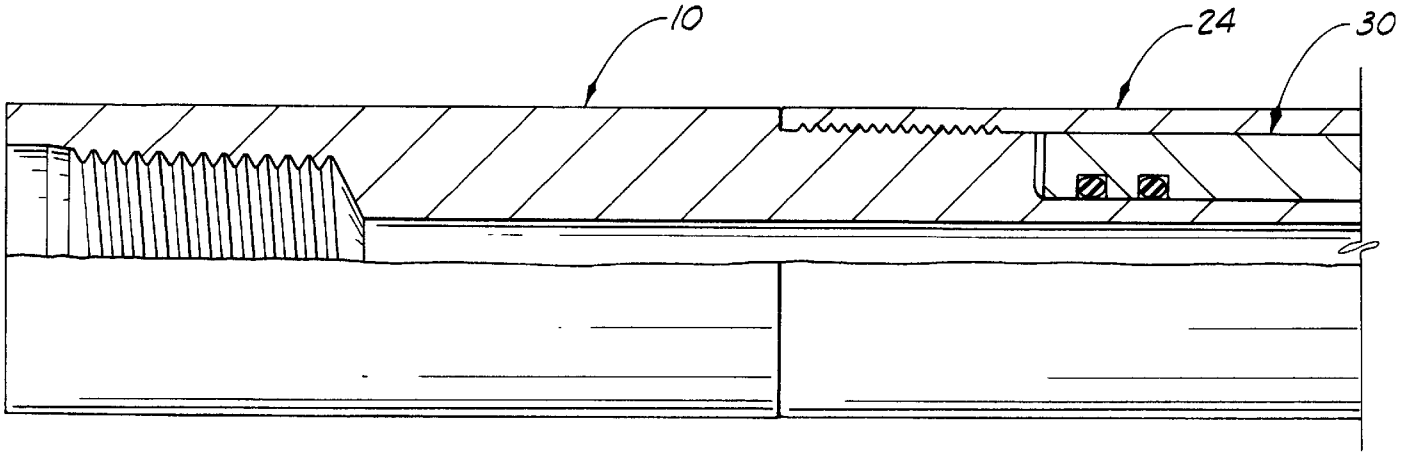
Figure 5B:
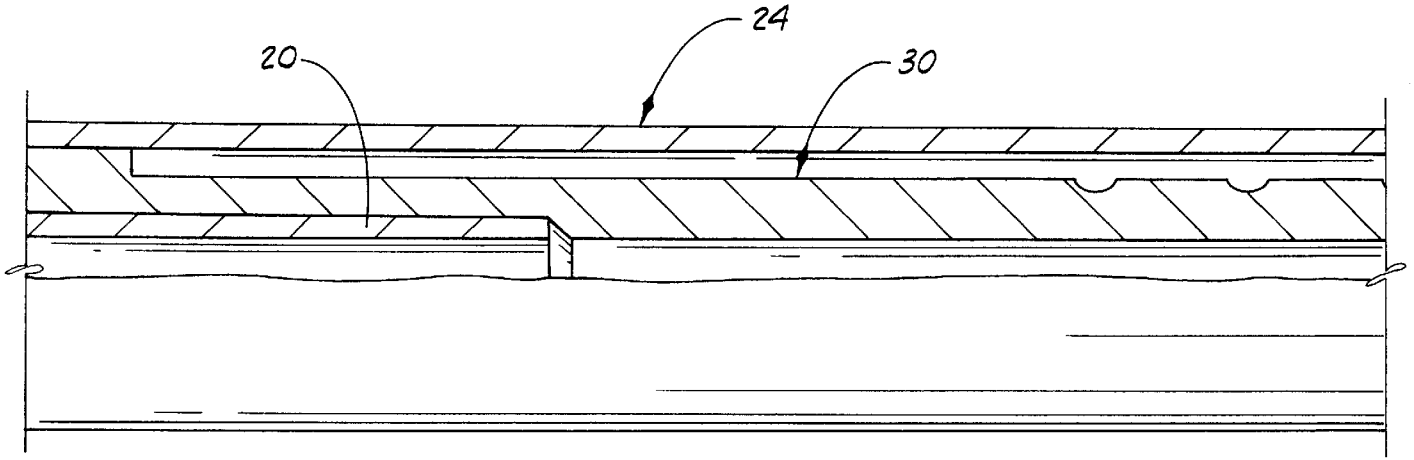
Figure 5C:
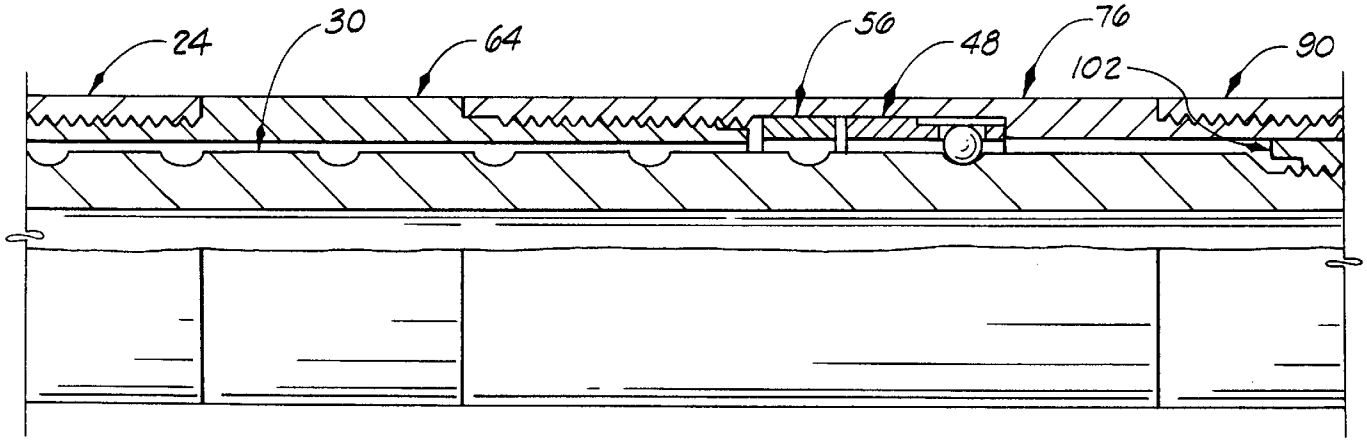
Figure 5D:
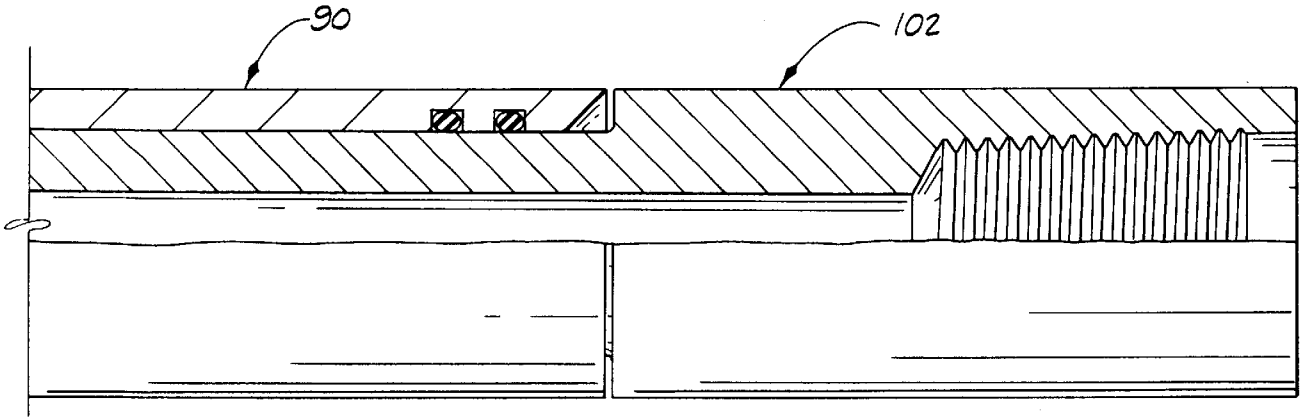

Thus, when the tubing string picks up on the top sub wash pipe . 10 by raising cylindrical block 14 (FIG. 1) the actuator is zeroed as the drive balls in capture hole 52 (FIG. 4A) ride all the way to the upper end of groove section 34 of drive mandrel 30. Thereafter, weight is supplied from the supporting string to the ball clutch drive to force it downward along the spiral shaft or groove section 34 (FIG. 3) at a predetermined rate which, in turn, proportionately controls the rate of rotation of the work piece attached to rotation shaft 102 (FIG. 8). Each groove of the groove section 34 makes five revolutions in a complete traverse. Thus, the shaft actuator is capable of a five rotation drive output at an annular speed that is dictated by the rate of application of weight to the cylindrical block 14 (FIG. 1). Thus, rotation may be imparted to the work tool such as a recovery basket or other fishing implement.

The foregoing discloses a novel implement for generating a rotational drive force downhole and for applying such rotation to a selected work tool that may be supported on a tubing string or the like. The rotation actuator is particularly useful for employ downhole as supported by a tubing string or other device that is not capable of controlled revolution. While each actuation of the rotor shaft yields five revolutions, it should be understood that repeated applications of weight to the tubing string may be utilized to generate a multiple of five revolutions in whatever total desired.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A borehole rotation actuator comprising:

a wash pipe including an elongated tube, said wash pipe being attachable for suspension in the borehole;

a mandrel having plural equi-spaced spiral grooves extending along the length and terminating thereon to define a maximum rotation, said mandrel being slidable onto said wash pipe elongated tube and said mandrel adapted to connect to a working tool;

a plurality of ball bearings disposed to ride in each of the respective plural spiral grooves; and support means secured to the wash pipe and extending adjacent said mandrel while supporting a ball clutch plate rollably engaging each of said plurality of ball bearings;

whereby said wash pipe weight is removed from the mandrel to cock the actuator, and said wash pipe weight is applied to the mandrel to move the plural ball bearings along the spiral grooves to rotate the mandrel and working tool for a predetermined amount of rotary movement.

2. A borehole rotation actuator as set forth in claim 1 wherein:

said spiral grooves completing five turns around the mandrel; and the full rotation of the mandrel and working tool makes five complete turns.

3. A borehole rotation actuator as set forth in claim 1 where said support means comprises:

an upper drive housing cylinder secured to said wash pipe and extending the lower end over said mandrel;

a twin pin drive connector threadedly secured to the lower end of the housing cylinder;

a ball clutch cylinder sliding on said mandrel beneath said twin pin connector and presenting a downward array of ratchet teeth and upward facing bosses disposed 180° apart;

a ball clutch sleeve defining the ball clutch plate and sliding on said mandrel beneath said twin pin connector and presenting an upward array of ratchet teeth while plural equi-spaced holes retain said plural ball bearings while also riding in said spiral grooves;

a lower rotor housing threadedly connected to said twin pin drive connector; and bottom rotation shaft secured to said mandrel to receive said working tool.

4. A borehole rotation actuator as set forth in claim 3 wherein:

said spiral grooves completing five turns around the mandrel; and the full rotation of the mandrel and working tool makes five complete turns.

5. A borehole rotation actuator comprising:

a mandrel having at least one spiral groove extending along at least a portion of the length of said mandrel;

a plurality of ball bearings disposed to ride in the at least one spiral groove; and a support structure extending adjacent said mandrel while supporting a ball clutch member rollably engaging each of said plurality of ball bearings;

wherein said actuator is cocked in response to a lifting force applied to one of said mandrel and said support structure, and wherein a set down weight is applied to move the plural ball bearings along the at least one spiral groove to rotate the other of said mandrel and said support structure within the range between a partial revolution and a predetermined maximum number of revolutions before a subsequent lifting force is applied.

6. A borehole rotation actuator comprising:

an external housing;

a drive mandrel rotatably and slidably disposed in the external housing, the drive mandrel having a plurality of spiral grooves extending along at least a portion of the drive mandrel; and a ball clutch assembly including:

a ball clutch cylinder having an array of ratchet teeth;

a ball clutch sleeve having an array of ratchet teeth to work with the array of ratchet teeth of the ball clutch cylinder, the ball clutch sleeve further having a plurality of holes wherein each hole receives a respective clutch ball disposed in a respective groove of the drive mandrel; and wherein the ball clutch cylinder and the ball clutch sleeve are disposed in the external housing and around the drive mandrel such that (1) the arrays of ratchet teeth rotate relative to each other in response to a first longitudinal force applied to the borehole rotation actuator in a borehole and (2) the arrays of ratchet teeth engage each other to prevent rotation relative to each other and to thereby force rotation between the drive mandrel and the external housing in response to a second longitudinal force applied to the borehole rotation actuator.

7. A borehole rotation actuator as set forth in claim 6, wherein the first longitudinal force is a lifting force and the second longitudinal force is a set down weight.

8. A borehole rotation actuator as set forth in claim 6, wherein:

the external housing includes:

a first end member;

a support housing connected to the first end member;

a connector connected to the support housing;

a drive housing connected to the connector and having the ball clutch assembly disposed therein; and a second end member connected to the drive housing; and the borehole rotation actuator further comprises a shaft having a first end disposed through the second end member and connected to the drive mandrel and further having a second end disposed outside the second end member.

9. A borehole rotation actuator as set forth in claim 8, wherein the ball clutch cylinder engages the connector to prevent rotation therebetween.

10. A borehole rotation actuator as set forth in claim 9, wherein:

the connector is a twin pin connector having a plurality of boss slots defined in one end thereof; and the ball clutch cylinder has a plurality of bosses received by the boss slots.

11. A borehole rotation actuator as set forth in claim 10, wherein the first longitudinal force is a lifting force and the second longitudinal force is a set down weight.

* * * * *

UNITED STATES PATENT AND TRADEMARK OFFICE

CERTIFICATE OF CORRECTION

PATENT NO. : 5,918,690

DATED : July 6, 1999

INVENTOR(S) : Charles D. Hailey

It is certified that error appears in the above-identified patent and that said Letters Patent is hereby corrected as shown below:

Column 2, line 35, change "to1.0" to --to 1.0--.

Column 2, line 40, change "0-rings" to --O-rings--.

Column 3, line 14, change "0-ring" to --O-ring--.

Column 3, line 28, change "referring" to --Referring--, and insert --the-- before "shaft".

Column 4, line 19, delete the "." after "pipe".

Column 5, line 30, insert --a-- before "bottom".

Signed and Sealed this

Fourth Day of July, 2000

*Attest:*

*Attesting Officer*

Q. TODD DICKINSON

*Director of Patents and Trademarks*